US010144564B2

(12) United States Patent
Seddon et al.

(10) Patent No.: US 10,144,564 B2
(45) Date of Patent: Dec. 4, 2018

(54) CONTAINER CAP

(71) Applicant: Vinnovate Pty Ltd, Nuriootpa (AU)

(72) Inventors: Jon Graham Seddon, Burwood (AU); Michael Russell, Burwood (AU)

(73) Assignee: VINNOVATE PTY LTD, Nuriootpa (AU)

( * ) Notice: Subject to any disclaimer, the term of this patent is extended or adjusted under 35 U.S.C. 154(b) by 0 days.

(21) Appl. No.: 15/326,338

(22) PCT Filed: Jul. 9, 2015

(86) PCT No.: PCT/AU2015/000403

§ 371 (c)(1),
(2) Date: Jan. 13, 2017

(87) PCT Pub. No.: WO2016/007986

PCT Pub. Date: Jan. 21, 2016

(65) Prior Publication Data

US 2017/0210526 A1 Jul. 27, 2017

(30) Foreign Application Priority Data

Jul. 15, 2014 (AU) ..... 2014902734

(51) Int. Cl.
*B65D 51/28* (2006.01)

(52) U.S. Cl.
CPC ..... *B65D 51/2835* (2013.01)

(58) Field of Classification Search
CPC ..... B65D 51/2835; B65D 51/2828; B65D 51/2871

(Continued)

(56) References Cited

U.S. PATENT DOCUMENTS 3,220,588 A 11/1965 Lipari
4,634,003 A * 1/1987 Ueda ..... B65D 81/3222 206/221

(Continued)

FOREIGN PATENT DOCUMENTS

GB 2476297 6/2011
WO 2006/046730 A1 5/2006

(Continued)

OTHER PUBLICATIONS

European Patent Office, Extended European Search Report dated May 29, 2017 for European Patent Application No. 15821871.9, Applicant Vinnovate Pty Ltd.

*Primary Examiner* — Chun Cheung
(74) *Attorney, Agent, or Firm* — Greenberg Traurig, L.LP.; Joshua R. Brown; Corrine M. LaGosh

(57) ABSTRACT

A cap for a container, wherein the cap is adapted to be positioned across the mouth of a container, the cap comprising:

an upper portion that lies across the mouth of a container;

a sealed compartment for storing contents to be added to the container interior, the compartment being located below the upper portion, and defined by a lower membrane and a wall extending between the upper portion and the lower membrane, wherein the lower membrane is rupturable; and a piercer in the sealed compartment that is actuable through the upper portion to pierce the lower membrane, wherein the piercer is configured to form a passage therethrough to open the compartment to the container interior.

14 Claims, 6 Drawing Sheets

(58) Field of Classification Search
USPC ..... 206/222, 219; 220/521, 267, 277, 258.4
See application file for complete search history.

(56) References Cited

U.S. PATENT DOCUMENTS 4,785,931 A * 11/1988 Weir ..... B65D 51/2835 206/222
6,305,576 B1 10/2001 Leoncavallo
6,513,650 B2 * 2/2003 Mollstam ..... A61J 9/00 206/219
6,976,578 B1 * 12/2005 Kenihan ..... B65D 51/2835 206/219
8,016,104 B2 * 9/2011 Hjalmarsson ..... B65D 51/225 206/219
8,770,399 B2 * 7/2014 Hjalmarsson ..... B65D 51/2821 206/219
8,839,982 B1 9/2014 Anderson et al.
2007/0215496 A1 * 9/2007 Scarborough ..... B65D 51/221 206/222
2009/0020495 A1 * 1/2009 Cheng ..... B65D 51/2835 215/316
2009/0242561 A1 * 10/2009 Wellman ..... B65D 51/2828 220/277
2014/0202895 A1 * 7/2014 Larson ..... B65D 51/2835 206/222
2014/0209490 A1 * 7/2014 McKeown ..... B65D 51/2821 206/222
2014/0305818 A1 * 10/2014 Lee ..... B65D 51/2835 206/222
2015/0016208 A1 * 1/2015 Larson ..... B01F 15/0212 366/130

FOREIGN PATENT DOCUMENTS

WO 2006123946 11/2006
WO 2012/171529 A1 12/2012
WO 2014/027830 A2 2/2014

* cited by examiner

CONTAINER CAP

The present invention relates to a cap for a container and specifically of the kind that can store and release content into a container.

BACKGROUND

There are many reasons why it may be desired to mix additives or supplements with a liquid contained in a container. One example relates to beverages. In a health sense there may be the desire to add dietary supplements to water to create a healthy mixed drink. In the wine industry adding certain additives to wines will neutralize the effects of preservatives and other chemicals used in the wine making process that can cause unpleasant side effects in some people.

In another example, domestic cleaning products or fertilizers and the like used in gardening are sometimes activated by adding an activating substance to a base liquid.

Dispensers can be employed to dispense and release an additive into a container containing a base product, such as water, and it has been known to incorporate these dispensers into closures for containers. However such dispensers can be unreliable as well as expensive to produce as they take the form of complex mechanisms, which can also be unsightly and intrusive on the aesthetics of a product.

It is these considerations that have brought about the presently described cap for a container.

SUMMARY

In accordance with the invention there is provided a cap for a container, wherein the cap is adapted to be positioned across the mouth of a container, the cap comprising:

- an upper portion that lies across the mouth of a container;
- a sealed compartment for storing contents to be added to the container interior, the compartment being located below the upper portion, and defined by a lower membrane and a wall extending between the upper portion and the lower membrane, wherein the lower membrane is rupturable; and
- a piercer in the sealed compartment that is actuable through the upper portion to pierce the lower membrane, wherein the piercer is configured to form a passage therethrough to open the compartment to the container interior.

The upper portion may define an upper wall of the sealed compartment, or alternatively a separate ceiling located below the upper portion could form the upper wall of sealed compartment.

It is understood that the lower membrane may itself form the wall of the sealed compartment by curving from a lower plane to meet the upper wall/upper portion thereby forming an enclosure with the upper wall that is sealed to form the sealed compartment.

In a preferred embodiment, the piercer deflects the pierced lower membrane to clear a passage therethrough using a deflector. The piercer may also include a channel to define the passage through the lower membrane and open the compartment to the container interior.

In a preferred embodiment the lower end of the piercer has a cutting edge. More preferably the lower cutting edge is closed or substantially closed.

By 'closed' it is meant that the edge follows a closed line, for example in the form of an annular edge or a square/rectangular edge.

When used to pierce the lower membrane the closed edge forms a substantially closed cut piece in the membrane, for example a circle, oval or rectangle. The piece may be completely cut from the membrane or may be attached to the membrane by a hinge. By cutting a piece that is almost completely cut, or is completely cut, from the lower membrane a passage is able to be formed because the piercer will deflect the piece as it moves through the lower membrane.

In one embodiment the lower cutting edge ends in a point defined by an incline angled relative to the direction of travel of the piercer so that the point of the cutting edge contacts the lower membrane before an opposing side opposite the point of the cutting edge. Furthermore, the cutting edge, when either closed or substantially closed defines an area enclosed by the edge that is greater than an area defined by a channel of the piercer.

A deflector edge adjacent the lower cutting edge may be provided to deflect a cut piece away from the lower membrane to thereby assist in forming a passage into the compartment.

In an embodiment, the piercer is post-shaped that defines a channel and has an open side to allow fluid/contents to pass through the open side and through the lower cutting edge.

The lower membrane may be made of a double sided lacquer coated foil, or it could be made of a laminated plastic heat sealing aluminium foil. The lower membrane is preferably heat/induction welded or otherwise adhered to a lower edge surface of the wall to provide a sealed bond.

The cap is preferably mostly moulded from plastics with the lower membrane heat sealed across the lower surface of the wall to form the sealed compartment, which is first filled with content to be added to liquid or other content contained in the container.

In a preferred embodiment the piercer remains in the pierced condition. This can be achieved by having an upper portion that includes a flexible member that can be depressed to actuate the piercer but that is also permanently deformable in that once the flexible member is pressed it remains pressed to make it evident that the piercer has been actuated to pierce the lower membrane and the content in the compartment has been released and mixed with any content in the container.

The flexible member may be lined with an outer flexible membrane. In one embodiment the piercer is formed, or moulded, with a domed ceiling of the sealed compartment, which is also formed as a single component together with the wall of the compartment and a flange on the upper portion.

Alternatively, the flexible member may be resilient and return to its original, rest position. The flexible member may be made of plastics.

In yet another embodiment it is envisaged that the cap may be provided with two, three or more sealed compartments for storing contents, where each sealed compartment is provided with a piercer that is independently actauble relative to the piercer(s) of the other compartment(s).

There is also provided in accordance with the invention a closure for a container comprising a cap as described above and a lid overlying the cap to fix the cap in position on a container. The lid may also be known as an overcap.

The lid may have an opening at a top end to provide access to the upper portion of the cap. Alternatively, there may be no opening and the top of the lid can be flexible through which the upper portion can be pressed. The closure may also have a seal that lies between the upper portion of the cap and a wall surrounding the mouth of a container. The lid may have means for attaching to a container, for example an internal screw thread. Alternatively the lid may be crimped or otherwise attached to the container. Still alternatively, a wrapper may wrap the lid to a container.

BRIEF DESCRIPTION OF THE DRAWINGS

An embodiment, incorporating all aspects of the invention, will now be described by way of example only with reference to the accompanying drawings in which.

DETAILED DESCRIPTION OF PREFERRED EMBODIMENTS

Figure 7:
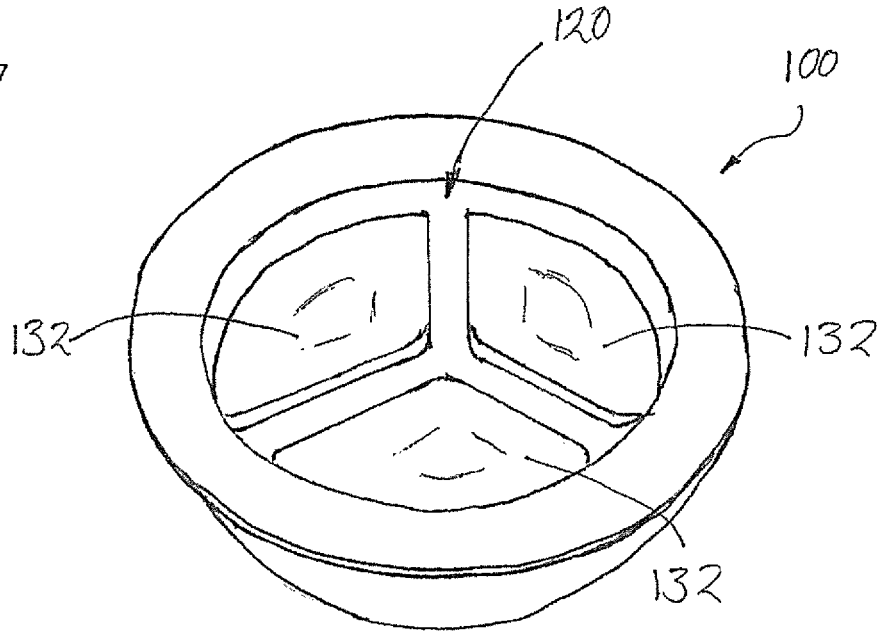
FIG. 7 is an upper perspective view of another embodiment of the cap.
Figure 8:
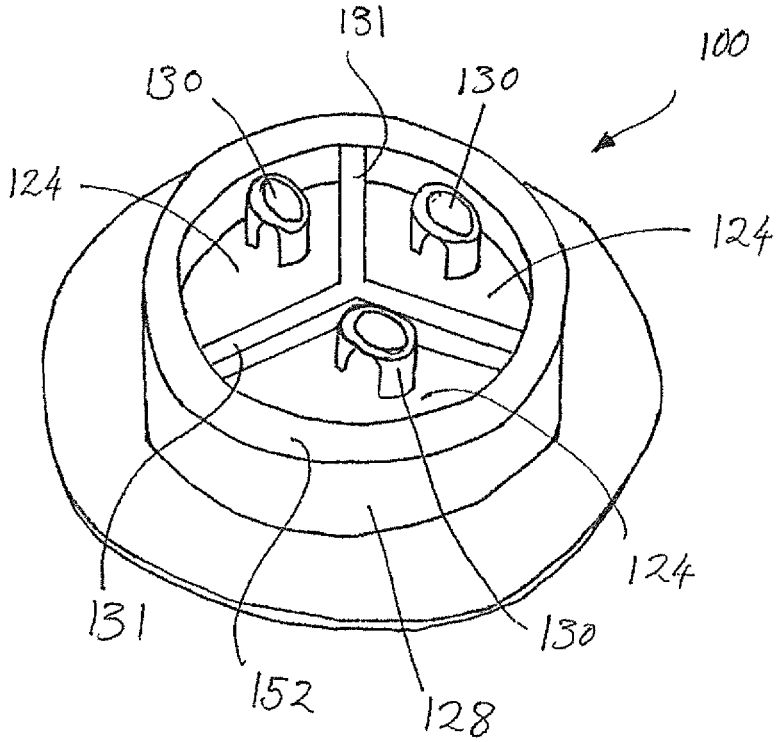
FIG. 8 is a lower perspective view of the cap of FIG. 7 with the lower membrane removed for clarity.

FIGS. 1 to 6 illustrate a preferred embodiment of a cap 10 for use on a container. FIGS. 7 and 8 illustrate one possible modification of the cap. The cap is of the kind that is used to store then dispense a substance contained in the cap, such as an additive, into a container upon actuation of the cap.

In the specific embodiment illustrated and described herein the container is a bottle 12 and the cap 10 is fixed across the mouth 14 of the bottle. The cap is generally provided with a closure assembly (closure) 16 (shown in exploded view in FIG. 1) that acts to position and fasten the cap across the mouth of a container/bottle. In use, the cap may be provided with a closure assembly and sold together with the bottle/container. Alternatively, the cap maybe provided as a separate component containing a substance to be dispensed and which a user can apply themselves to the mouth of the bottle/container to dispense a substance.

The cap includes an upper portion 20 that is adapted to lie across the mouth 14 of a bottle/container. The upper portion is generally circular in shape and includes an outer annular flange 21 that is designed to seat directly or indirectly (through an intermediate seal component—not shown) on the lip 15 of the bottle mouth 14 and thereby position the cap across the mouth of the bottle.

The cap also includes a sealed compartment 24 in which contents to be added to the interior of the bottle/container are stored. The sealed compartment avoids mixing of the compartment's content and the container's content until the user desires the contents to be mixed. In one embodiment envisaged, the sealed compartment contains a preservative neutralising additive to be added to a beverage stored in the container, such as wine. The additive is generally added to wine immediately before consumption. One example of an additive is hydrogen peroxide.

The sealed compartment is located below the upper portion, and is defined by the upper portion 20, a rupturable lower membrane 26 and a wall 28 extending between the upper portion and lower membrane. The sealed compartment 24 extends from an underside of the upper portion 20 and has an area that is smaller than that of the upper portion so that while the upper portion is designed to lie across a seat on the lip 15 of a bottle 12, the sealed compartment 24 is designed to position inside of the bottle's mouth 14. In the embodiment shown where the cap is circular, the sealed compartment has a diameter that is smaller than a diameter of the upper portion.

The sealed compartment 24 contains a piercer 30 that is designed to pierce the lower membrane 26 on actuation of the cap 10. Specifically, the piercer is actuable through the upper portion, for example, a force applied to the upper portion, to move from a stationary position in the sealed compartment to a pierced position where the piercer 30 extends through the lower membrane to form a passage therethrough and open the sealed compartment to an interior 18 of the bottle/container.

The upper portion may not necessarily define the upper wall or ceiling of the sealed compartment. There may be provided a separate ceiling located below the upper portion that could form the sealed upper wall of the compartment.

Figure 5:
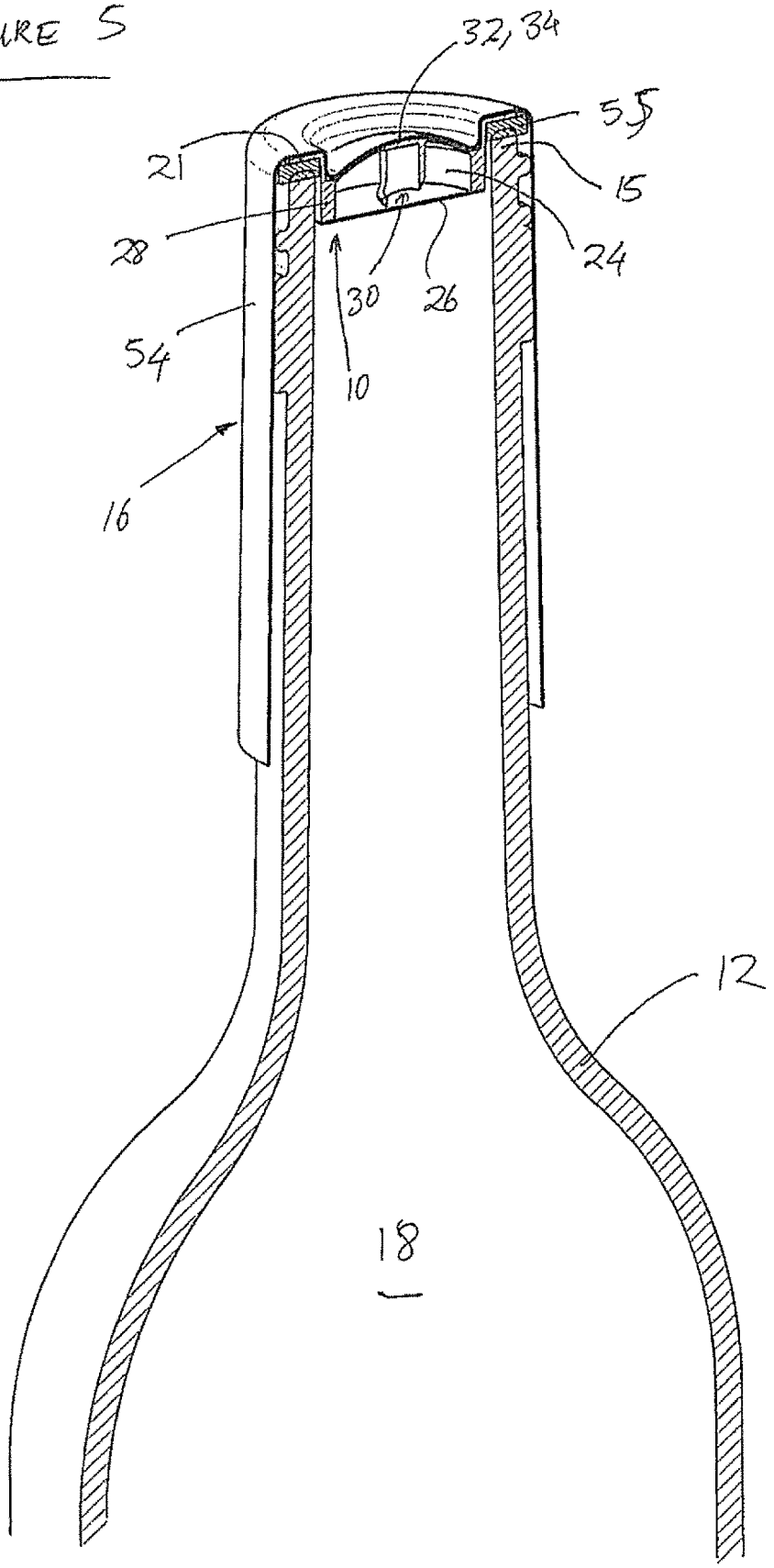
FIG. 5 is a first sectional perspective view of the cap with a closure assembly mounted on a bottle before activation.

FIG. 5 illustrates a cap 10 positioned across the mouth of a bottle 12, and held in place by a closure assembly 16, in which the piercer 30 is in a primed position ready to be actuated to pierce the lower membrane.

Figure 6:
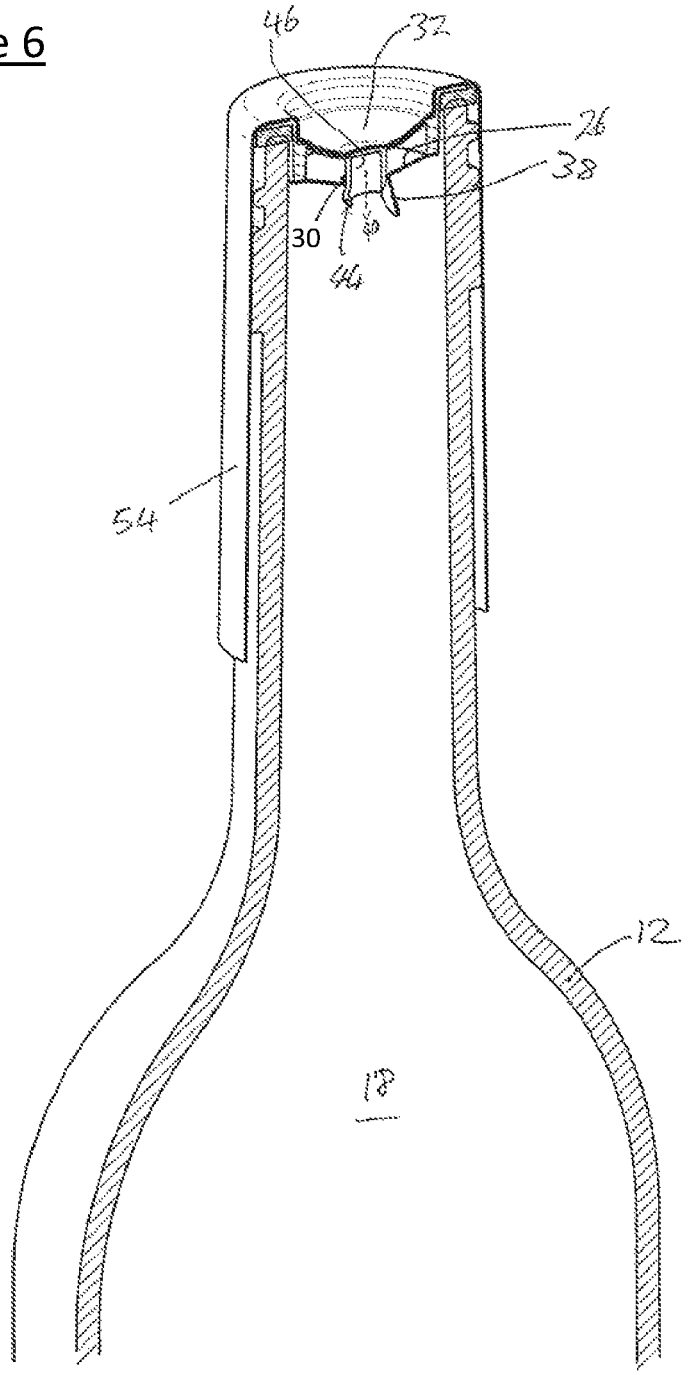
FIG. 6 is a second sectional perspective view of the cap with a closure assembly mounted on a bottle after activation.

FIG. 6 shows the piercer having been actuated to travel through the sealed compartment and pierce the lower membrane 26 to form a passage through the lower membrane that opens the compartment 24 to the bottle interior 18 to allow the transfer of content out of the compartment 24 and/or the transfer of fluid in the bottle into the compartment (for example by tipping the bottle upside down to flush out the content of the compartment).

The upper portion 20 includes a flexible member 32. Flexible member 32 in the embodiment shown is located centrally of the upper portion 20 to lie across, and form an upper wall, of the sealed compartment 24. The flexible member can be depressed relative to the rest of the cap to actuate the piercer to travel through the sealed compartment 24 and pierce the lower membrane 26. The piercer is connected to the underside of the flexible member 32 of the upper portion to respond and be actuated in response to a pressing action on the flexible member.

Figure 1:
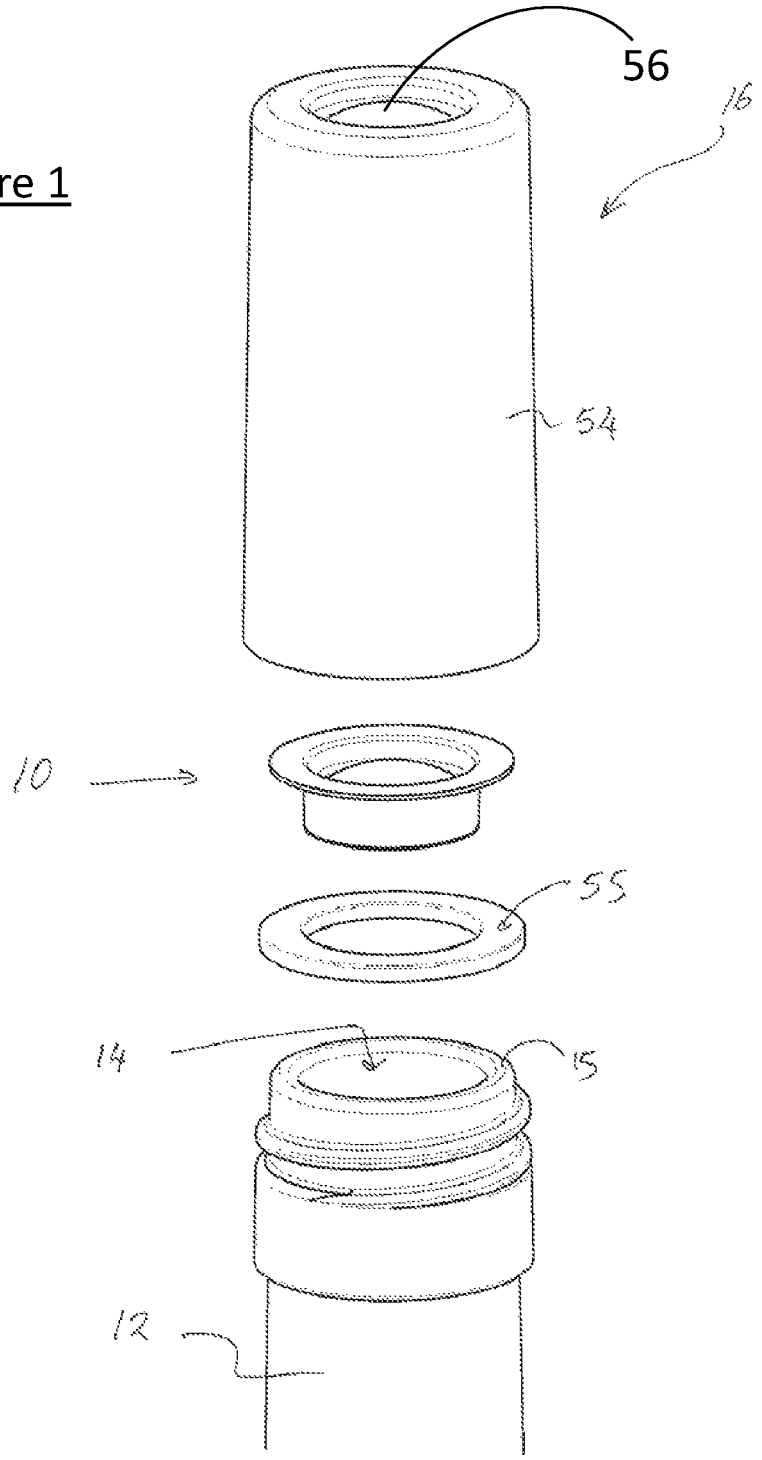
FIG. 1 is an exploded view of a closure assembly with a cap in accordance with the invention.
Figure 2:
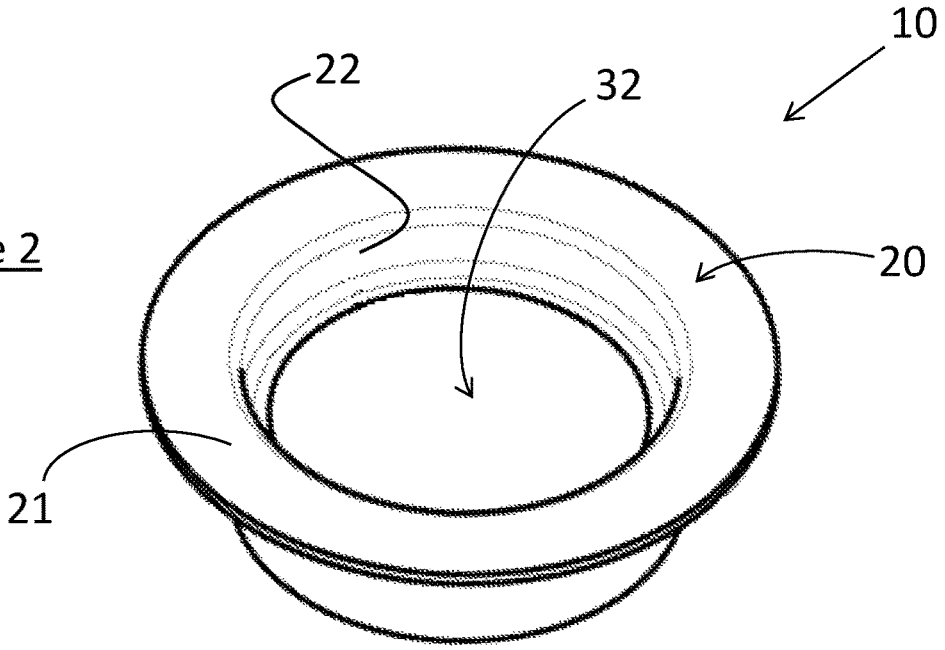
FIG. 2 is an upper perspective view of the cap.
Figure 4:
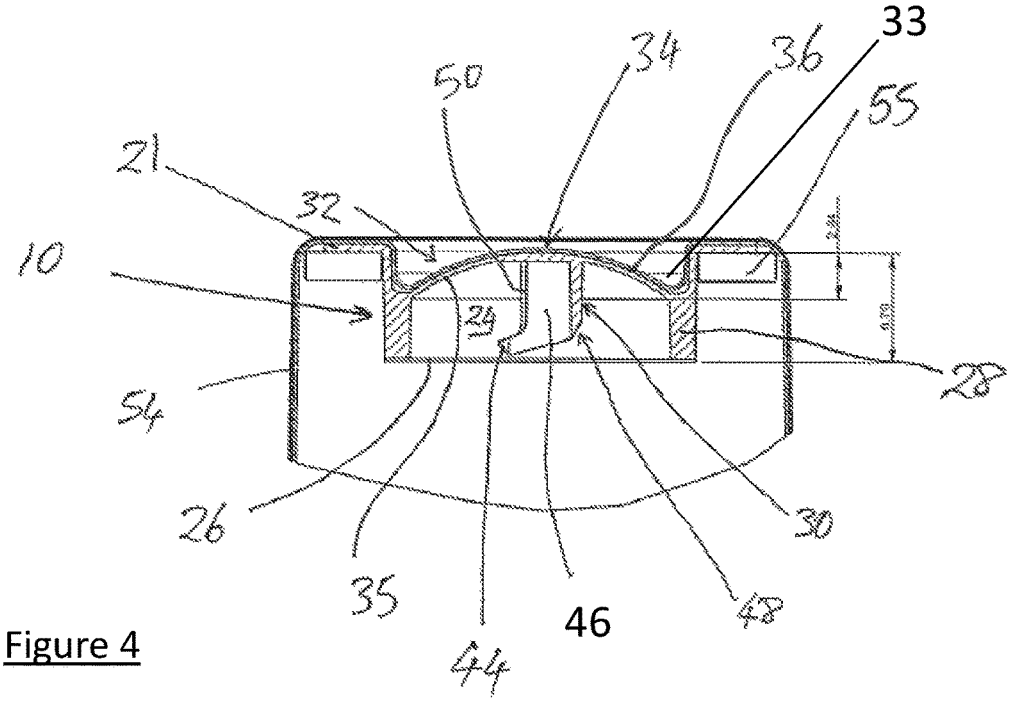
FIG. 4 is a side sectional view of the cap assembled with a closure assembly.

Flexible member is convex or domed in shape to form a "button" 34. The convex shape is illustrated in FIGS. 2 and 4. To maintain compactness of the cap the apex of the convex flexible member/button does not exceed the height or upper limit of the cap as determined by the upper portion and in particular the flange 21. Accordingly, the convex structure of the flexible member is defined at its circular periphery by a channel 33 where the flexible member of the upper portion meets a shoulder 22 defining an inner periphery of the flange 21.

Flexible member 32 comprises a flexible membrane 36 and a domed part forming the ceiling of the sealed compartment 24. FIG. 4 illustrates the cap in side cross sectional view from which it can been seen that the flexible member 32 is made of two parts: a domed ceiling 35 that is moulded with the wall 28 of the sealed compartment 24; and an outer flexible membrane 36 that lines the outside of the flexible member 32 and in the embodiment shown lines the entire upper portion 20 including flange 21. Accordingly, flange 21, shoulder 22, wall 28 and domed ceiling 35, as well as the piercer 30 are all moulded as a single component preferably from plastics. One example of plastics material that could be used is injected moulded polypropylene.

Alternatively or additionally, the cap may be lined on an inside and/or outside with a flexible membrane. This will provide stability yet flexibility as well as other possible features such as air/light barrier and chemical inertness.

While the preferred embodiment illustrated in the drawings and described herein show the cap being formed from a moulded plastics component that is lined across the upper portion with a flexible membrane, it is understood that other manufacturing techniques could be employed where one or more of the components are formed separately and attached by other routine means. This may for example be desirable where the piercer is made out of a different material than the main material of the cap, for example of metal.

The domed ceiling 35 supports the flexible membrane 36 to provide a convex "button" like structure on the upper portion of the cap. In some embodiments flexible membrane 36 may be resilient, or simply flexible, to return to the convex, rest position after it has been pressed. In these embodiments the flexible membrane may be made of a resilient plastics material.

However in other embodiments, such as that illustrated in the drawings, the flexible member is deformable in that it urges the flexible member 32 to remain in the depressed position as illustrated in FIG. 6. The domed ceiling 35 too, will exhibit deformable characteristics to remain in a depressed position, or at least be sufficiently thin to apply no resistance to the deformed flexible membrane 36 in maintaining it in the depressed position.

The flexible membrane 36 may be made of a foil material, such as pressed aluminium, or a foil laminate or plastics material, that is deformable to keep the "button" depressed.

Accordingly, the flexible member forming the button 34 of the cap is permanently deformable in the embodiment illustrated. This is useful to visually indicate that the cap has already been actuated and the additive substance released from the sealed compartment, and can be used a tamper evident feature. Other tamper evident design features may also be included in the cap, such as tamper evident breakable rings, paper strip seals and foil overwrap where removal or breaking of the foil, rings or strips can be evident.

The piercer 30 is designed to pierce the lower membrane 26 when actuated and also to deflect a pierced portion 38 of the lower membrane out of the way of a passage 40 formed through the lower membrane. Piercing a passage and clearing the passage of cur portions of the lower membrane ensures clear access is formed between the compartment 24 and the outside compartment, which in use is typically the interior 18 of a bottle/container 12. Without the removal or clearing of pierced portions 38 of the lower membrane, the pierced portions could interfere with or even move to block the passage 40 with the exchange of fluids (in the form of liquid in the container and/or liquid/solid in the compartment) across the lower membrane 26.

Figure 3:
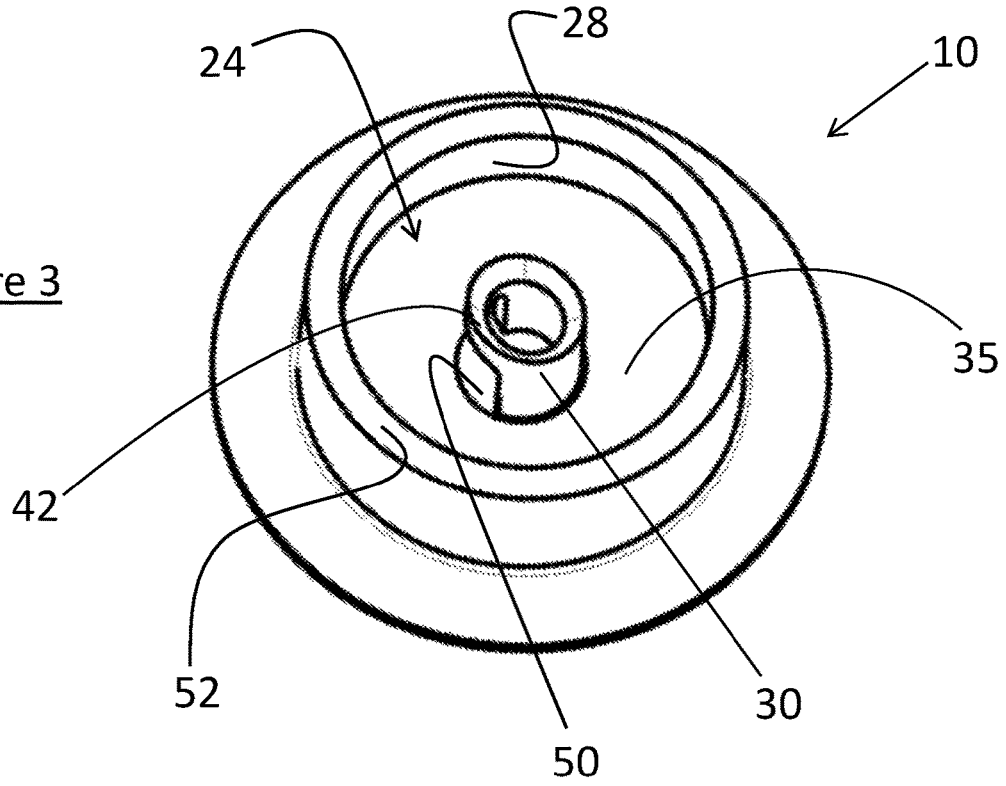
FIG. 3 is a lower perspective view of the cap with the lower membrane removed for clarity.

The piercer 30 has a lower cutting edge 42 that forms a closed edge, or a substantially closed edge. By the term "closed" it is meant that the edge forms a continuous edge, or almost a continuous edge, that could for example be annular or square in shape. FIG. 3 which illustrates the underside of the cap 10 best shows the closed form of the cutting edge 42. Accordingly, the closed edge creates a substantially closed pierced portion 38 of the lower membrane that is, for example, circle or oval in shape. This more complete form of the pierced portion, compared to merely one or two slits in the membrane, allows it to be more easily separable from the lower membrane and be deflected.

The pierced portion may either be completely cut or attached to the rest of the lower membrane by a flap of uncut material acting as a hinge. As the piercer travels further through the lower membrane the cutting edge 42 will cause the pierced portion 38 to deflect down and away from the cutting edge to thereby clear a passage 40 through the lower membrane.

The cutting edge 42 as best illustrated in FIGS. 3 and 4, is inclined relative to a direction of travel to the piercer and includes a sharp point 44 defined by the lowest edge of the inclined cutting edge so that the sharp point 44 is the first part of the cutting edge to make a contact with the lower membrane 26. Point 44 pierces the lower membrane and the remaining cutting edge 42 tears or ruptures the lower membrane from the initial pierce to form a pierced or cut portion 38 of the lower membrane.

The cutting edge 42 also includes a small inclined deflector edge 48 that assists in deflecting a pierced portion 38 away from the lower membrane. As the piercer travels through the lower membrane deflector edge 48 acts as a cam surface to encourage the hinge (not shown) of the pierced portion 38 to bend further and move the pierced portion away from passage 40.

The piercer 30 includes a channel 46 that assists in defining the passage 40 through the lower membrane to open the compartment 24 to the container interior 18. The channel is formed by the piercer having an enclosed body wherein at least a part of the length of the piercer is a hollow enclosed body forming a channel therethrough. In the embodiment illustrated the lower part of the piercer has a cylindrically shaped body, or shaped as a post, that forms an open channel that is open to varying degrees. The post leads to the cutting edge 42 at its lower end. In the embodiment illustrated the channel 46 is an approximately half open channel having an open side 50. While the preferred embodiment shows a cylindrically shaped piercer body, it is understood that the piercer can comprise other shapes such as square.

Open side 50 encourages the exchange of fluids between the compartment and outside the compartment whereby fluid transfers through the channel and through the cutting edge, which has pierced passage 40.

As best illustrated in FIG. 3 and FIG. 4, the closed or substantially closed, the cutting edge 42 defines an internal area that is greater than an area defined by the channel 46 of the piercer 30. This encourages a larger pierced portion 38 to be formed than may be required by the access channel 46.

Lower membrane 26 is formed of a material that is easy to tear yet will provide a durable seal before tearing. The material may be a stiff material that can be scored with perforations, or other frangible means, to assist in easier tearing so that only a short movement of the piercer will pierce the lower membrane. In one embodiment the lower membrane is a lacquered coated foil, that can be lacquered on both sides of a foil substrate. Alternatively, the lower membrane could be made of a laminated plastic heat sealing aluminium foil or other piercable metal, plastic or composite membrane.

In one embodiment the lower membrane is made of a so-called 'push through lidding foil', which may be a laminated aluminium foil with a polymer barrier coating on one side of the membrane and a heat seal coating on the other side. The lower membrane could be a multi layered foil formed by various combinations of laminates and lacquers depending on the effect desired by the membrane. For example it may be desired that the membrane is chemically resistant to the contents of the bottle/container or to the contents of the sealed compartment, and so a suitably resistant material would be chosen.

Other desired characteristics of the lower membrane, but also the upper portion and the compartment walls could include providing a barrier to air or light. The parts forming the compartment, namely the lower membrane walls, and upper portion may also be chemically inert so as to maintain longevity of the container contents, particularly if the contents includes a substance that will react to air or metals or the like.

The lower membrane 26 is heat welded across a lower edge surface 52 of the wall 28 to provide a sealed bond. The lower edge surface 52 is treated to have a textured finish that makes it more suitable for heat welding. Additionally in this circumstance, the material of the lower membrane should be able to be heat welded.

In another embodiment the lower membrane 26 forms the lower surface of the sealed compartment and also the wall by shaping the lower membrane to curve and form an enclosure meeting the upper portion (this embodiment is not illustrated).

The closure 16 assists with positioning and fixing the cap 10 across the mouth of the bottle 12. The closure includes a lid 54 that overlies the cap 10 as an overcap to fix it in position on the bottle/container. The closure may also comprise a seal 55 (such as an O-ring) that lies between the flange 21 on the upper portion 20 of the cap and the lip 15 on the bottle. The closure may be made of a plastics or metal or a composite material, or a combination thereof.

The lid 54 may include an opening through which the "button" flexible member of the cap can be accessed without having to remove the lid. Alternatively, as illustrated in the drawings, the upper part or top of the lid that aligns above the button 34 may itself be flexible/deformable so that a user can press the button through the lid without requiring an opening in the lid. In this instance the top of the lid may, similar to the upper portion of the cap, be either flexible to return to its start condition after being depressed, or may be deformable to permanently invert after depression.

The lid 54 can be attached to a container, for example by an internal screw thread that screws onto an external thread on the container/bottle, or alternatively, the lid may be crimped or otherwise attached to the bottle. A separate wrapper (not shown) may be shrink wrapped over the lid and onto the container to attach the entire closure assembly and cap in place.

To use the invention a user either removes the lid 54 of the closure assembly or accesses the cap 10 through the opening 56 in the lid, and presses the flexible member 32, which acts as a button. On depression of the flexible member the piercer is actuated to travel from its primed position inside the sealed compartment containing a substance to be mixed, toward and through the lower membrane 26 to its pierced position and in doing so pierces and tears a portion 38 of the lower membrane 26 away from the lower membrane to form a passage 40 in the lower membrane. The piercer is designed to clear a passage free from cut portions 38 of lower membrane and to deflect the portions away from passage 40 to provide clear access for fluids (including liquids and flowable solid particulate substances) to flow across the lower membrane and to thereby create a mixture in the container of the original content of the container with the substance contained in the sealed compartment.

By way of example, in one embodiment of the cap when applied to a closure for a wine bottle, the piercer travels an average distance of 5.60 mm to pierce and clear the lower membrane. The sealed compartment in that example has an estimated volume of 0.93 milliliters.

It is understood that where a user may not desire to dispense the content of the sealed compartment into the container, the cap 10 will function as a regular cap where it can be removed and reapplied to open and close the bottle. The flexible press button 34 is envisaged to have sufficient stiffness to prevent accidental/inadvertent depression of the button.

In the process of manufacturing the described embodiment of the cap 10, the flange 21, shoulder 22, wall 28 and domed ceiling 35 of the cap is first moulded as an integral body. The flexible membrane 36 is then applied across the upper portion 20 of the moulded body by heat sealing, chemical adhesion or any other known joining technique. With the underside of the cap facing upward, an additive substance is then deposited inside the cavity that will form the sealed compartment, and then the lower membrane is applied and heat sealed over the edge surface 52 of wall 28 to seal the substance inside the compartment 24.

FIGS. 7 and 8 illustrate a modification of the concept of the cap illustrated in FIGS. 1 to 6. While the above embodiment is described as having a single sealed compartment, the cap 100 of FIGS. 7 and 8 comprises more than one sealed compartment containing a piercing element and in fact illustrates three compartments 124. Each compartment contains a piercer 130 that is actuable through a flexible membrane 132 of an upper portion 120 of the cap, where each piercer 130 can be separately and independently pressed to pierce the lower membrane (not shown in FIGS. 7 and 8) and release only the contents of the compartment of which the associated piercer/flexible membrane is pressed.

The compartments 124 are separated by dividing walls 131, which together with circumferential wall 128, provides an enclosed space that when sealed closed across a lower edge surface 152 with a lower membrane forms the sealed compartments.

Having multiple compartments can be useful where it is desired to have a multiple selection of additives or contents available for adding to the contents of a container. For example, if the cap finds use in the application of hot take away beverages, such as coffee, the different compartments could contain alternatives for sweeteners and/or flavourings. In that example one compartment could contain one measure of natural sugar, another compartment could contain another measure of natural sugar (to allow the option of two sugars for a serving of coffee) and a third compartment could contain one measure of an artificial sweetener.

In another example, the cap could contain flavoured sweeteners for adding to a base, non-flavoured drink. One example is carbonated water. The cap could be designed to contain a selection of popular flavours where one flavour is selected for dispensing into the carbonated water (or perhaps a combination of flavours could be selected depending on personal taste) to create a flavoured carbonated drink. One compartment may, for example, contain a lemon flavoured sweetener, another an orange flavoured sweetener and a third a cola flavoured sweetener.

It is of course understood that the number of multiple, separate sealed compartments will vary from 2, 3, 4, 5, 6 or more depending on the purpose of use of the cap and limited only by the size of the cap and the physical possibility of being able to create separate compartments within a cap size.

It is envisaged that the cap will find useful application in a range of fields including, but not limited to alcoholic and non-alcoholic beverages including: wine, beer, spirits, carbonated and still drinks, water purification/enhancement; dairy products; pharmaceutical preparations; agricultural chemicals; and cleaning agents.

It follows that the content of the sealed compartment can comprise various kinds of fluids including liquids and flowable or granular substances, depending on the intended use of the cap. The nature of the content of the sealed compartment will also vary significantly depending upon application and could include substances such as a flavour modifier, a texture modifier or a colour modifier.

The sealed compartment could be pressurized by a gas that is released into the container content when the cap is activated and pierces the compartment open thereby releasing the pressurised gas into the container, for example to carbonate a beverage.

Alternatively, the compartment may be pressurised together with contents to be dispensed to more quickly release the content into the container once the sealed compartment is opened.

In yet another embodiment it is envisaged that the compartment could be subjected to a negative pressure so the compartment is under a vacuum effect.

The presently described cap provides a simple to use means of adding an additive to the content of the container and ensuring the entire amount of additive is released in the container and/or fluid inside the container can access the compartment once opened. By providing a piercer that can clear a passage of pierced membrane, a more readily accessible passage is formed that will allow the complete transfer of substances across the lower membrane.

It will be understood to persons skilled in the art of the invention that many modifications may be made without departing from the spirit and scope of the invention.

The invention claimed is:

1. A cap for a container, wherein the cap is adapted to be positioned across the mouth of a container, the cap comprising:

an upper portion that lies across the mouth of a container;

a sealed compartment for storing contents to be added to the container interior, the compartment being located below the upper portion, and defined by a lower membrane and a wall extending between the upper portion and the lower membrane, wherein the lower membrane is rupturable; and a piercer in the sealed compartment that is actuable through the upper portion to pierce the lower membrane, wherein the piercer is a hollow body that includes an open channel therethrough that forms a passage through which contents pass to allow the exchange of contents between the compartment and the container interior, wherein the passage opens through to a lower end of the body, the lower end of the body having a closed cutting edge following a closed line, and wherein the piercer includes a deflector to deflect the lower membrane once pierced to clear a passage therethrough.

2. The cap claimed in claim 1, wherein the upper portion defines an upper wall of the compartment.

3. The cap claimed in claim 1, wherein the sealed compartment has a ceiling that is separate to and located below the upper portion.

4. The cap claimed in claim 1, wherein the deflector is defined by an edge on the piercer.

5. The cap claimed in claim 1, wherein the open channel is formed in at least a part of the length of the piercer.

6. The cap claimed in claim 1, wherein the piercer includes a lower cutting edge that is angled and ends in a point so that the point of the cutting edge contacts the lower membrane before a side of the cutting edge opposite the point.

7. The cap claimed in claim 1, wherein the piercer is connected to an underside of the upper portion.

8. The cap claimed in claim 1, wherein the upper portion is deformable so that once the piercer is actuated by depressing the upper portion, the upper portion remains deformed.

9. The cap claimed in claim 1, wherein the upper portion is flexibly resilient so that once the piercer is actuated by depressing, the upper portion returns to a rest position.

10. The cap claimed in claim 1, wherein the upper portion is domed to form a button that can be depressed.

11. The cap claimed in claim 1, wherein the lower membrane is made of a metallic foil, plastics or a metal/plastics laminate.

12. The cap claimed in claim 1, including two or more sealed compartments for storing contents.

13. A closure for a container comprising a cap claimed in claim 1, and a lid overlying the cap that fixes the cap on a container.

14. The closure claimed in claim 13, wherein the lid has a top through which the upper portion can be depressed.

* * * * *